US006484787B1

(12) United States Patent
Walters

(10) Patent No.: US 6,484,787 B1
(45) Date of Patent: Nov. 26, 2002

(54) WINDOW BLIND CORD STORAGE MEMBER

(76) Inventor: Paul A. Walters, 3925 Engle Rd., Fort Wayne, IN (US) 46804

( * ) Notice: Subject to any disclaimer, the term of this patent is extended or adjusted under 35 U.S.C. 154(b) by 0 days.

(21) Appl. No.: 09/715,422

(22) Filed: Nov. 17, 2000

(51) Int. Cl.[7] ..... E06B 9/30

(52) U.S. Cl. ..... 160/178.1 R; 242/388.2; 242/405.1; 24/716

(58) Field of Search ..... 160/178.1 R, 173 R, 160/168.1 R, 320; 24/716, 115 H, 706.1; 242/388.2, 388.1, 405.1, 405.2

(56) References Cited

U.S. PATENT DOCUMENTS 2,220,366 A * 11/1940 Fly ..... 242/405.1 X
2,590,695 A * 3/1952 Gomberg ..... 242/405.1
2,683,937 A * 7/1954 Criswell ..... 242/405.1 X
4,779,816 A * 10/1988 Varlet ..... 242/405.1 X
5,518,198 A * 5/1996 Chumbley et al. ..... 160/320 X
5,630,458 A * 5/1997 Holden ..... 160/178.1 R
5,749,405 A * 5/1998 Huang ..... 160/168.1 R
5,778,957 A * 7/1998 Torgersen ..... 160/178.1 R
5,803,390 A * 9/1998 Clary ..... 242/388.2

* cited by examiner

*Primary Examiner*—David M. Purol

(57) ABSTRACT

The subject invention is a holder for a window-shade cord to securely hold the cord in a temporarily stored position to prevent entanglement by the cord, particularly with a child, with the holder being structured to hold a portion of the cord as wound around two separated cord reel members on such holder, with the reel members being peripherally formed to permit circumferential movement of the temporarily encircled cord portion about such reel members as necessary to adjust the length of the cord on such cord holder.

4 Claims, 2 Drawing Sheets

WINDOW BLIND CORD STORAGE MEMBER

KNOWN PRIOR ART

| | | | |
|---|---|---|---|
| (1) | U.S. Pat. No. | 5,354,011 | (Rozon) |
| (2) | U.S. Pat. No. | 4,123,012 | (Hough) |
| (3) | U.S. Pat. No. | 4,271,893 | (McCluskey) |
| (4) | U.S. Pat. No. | 5,560,414 | (Judkin) |
| (5) | U.S. Pat. No. | 5,630,456 | (Hugo) |
| (6) | U.S. Pat. No. | 5,630,458 | (Holeden) |
| (7) | U.S. Pat. No. | 5,613,648 | (Pavila) |
| (8) | U.S. Pat. No. | 5,518,198 | (Chumbley) |

BACKGROUND OF INVENTION

The subject invention is primarily adapted and structured as a safety device for the protection of children. In a more specific perspective, the subject invention is conceived as a mechanism to help prevent young children from becoming entangled in a cord member that hangs loosely from an apparatus, under which circumstances a child may encounter the danger of strangulation or other bodily injuries, by reason of entanglement with the cord. To this end, the subject invention is conceived.

One of the primary applications of the subject invention, consistent with the original intent leading to its creation, is the situation involving slated venetian window blind cords that hang loosely in a dangling manner from a portion on the window blind apparatus. Such dangling cords in many circumstances may hang downwardly to a substantially low position relative to the floor areas near the blind. Under such latter circumstances a dangerous situation is encountered for young children who may be on the adjacent floor area and become entangled in the loose cord, posing thereby the potential problem of the cord becoming encircled about the neck or other body areas of the child. The ultimate danger of such a situation is manifest.

In a more specific perspective, window shades that are capable of being pulled up or down are generally actuated by pulling on an attached cord to raise or lower, open or shut, the shade members. The process of pulling on the cord and raising the window shade may cause an excess length of cord to dangle downwardly, usually leaving the cord at a lower level and close to the floor and thus accessible to children, as discussed above.

This aspect poses a problem of accidental entanglement by a child with the accessible cord, leading potentially to a strong possibility of strangulation.

There have been several devices conceived to overcome this problem some of which have been patented as set forth above. Many such devices have been conceived and structured in the form of reel members adapted to receive portions of the cord securely around a portion of the reel, in order to keep the cord securely out of reach. However, these devices are generally complex and unwieldy in structure and thus expensive to manufacture. On the other hand, many are structurally complex and difficult to utilize.

The subject invention relates to means used to securely store portions of a cord so that any loose portions of the cord are held in a position away from the reach of any person. In a more specific sense, the invention is also conceived as a more simplistically structured device, that is less costly and easier to use. Accordingly, the following are objects of the subject inventions as based on stated problems and purposes of this invention.

OBJECT OF INVENTION

It is an object of the subject invention to provide an improved device for securing window cords;

It is a function of the invention to provide a safety device to help protect children from becoming entangled in loose cord members dangling from any type device;

Another purpose of the subject invention is to provide an improved cord storage device;

An additional object of the subject invention is to provide a simplistic device to secure loose cords away from the reach of children;

Still another purpose of the subject invention is to provide an improved device for controlling the length of a window cord;

Yet another purpose of the subject invention is to provide an improved device for taking up the slack in a window shade cord or similar apparatus;

A further object of the subject invention is to provide an improved safety device relative to dangling cord members that may pose a problem of entanglement;

A further purpose of this invention is to provide a safety measure for keeping dangling cords out of reach of young children;

Other and further objects of the subject invention will become apparent from a reading of the following description taken in conjunction with the claims.

DESCRIPTION OF GENERAL EMBODIMENT AND SUMMARY OF INVENTION

Figure 1:
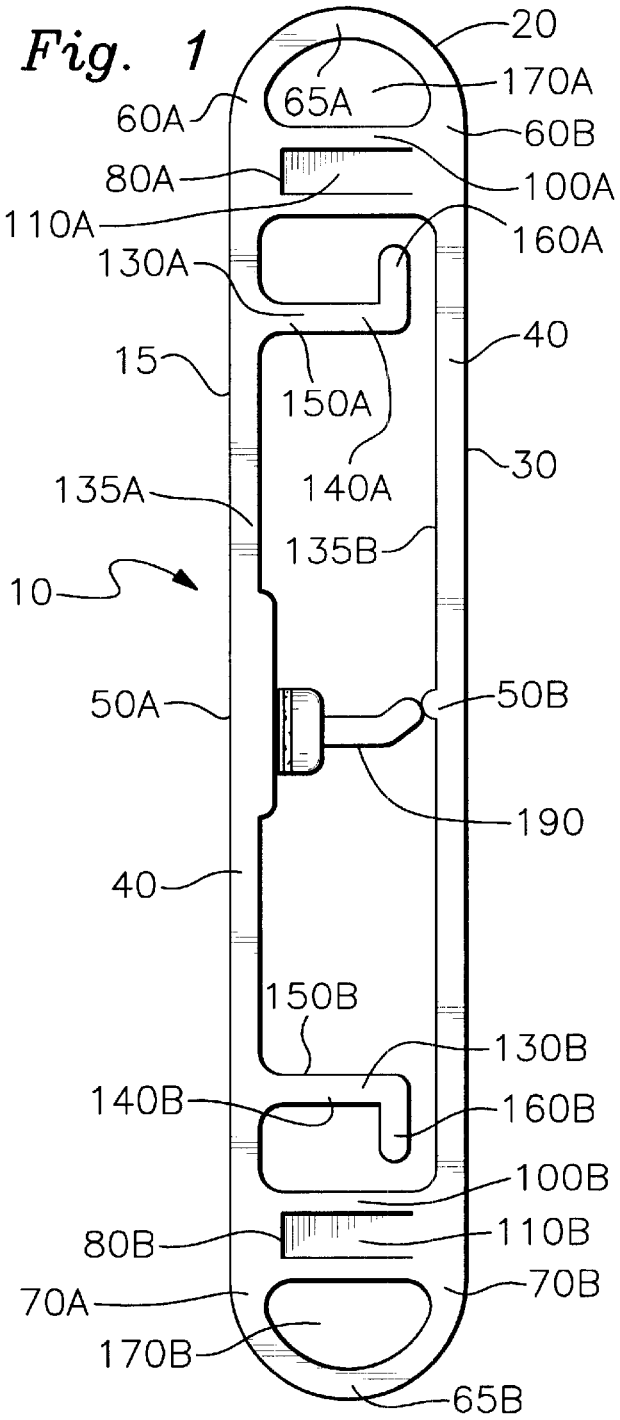
FIG. 1 (2) is a front elevational view of the apparatus incorporating the subject invention.

The subject invention is a holder for a window-shade cord to securely hold the cord in a temporarily stored position to prevent entanglement by the cord, particularly with a child, with the holder being structured to hold a portion of the cord as wound around two separated cord reel members on such holder, with the reel members being peripherally formed to permit circumferential movement of the temporarily encircled cord portion about such real members as necessary to adjust the length of the cord on such cord holder.

In a general and overall perspective of the subject invention, the device incorporating features of the subject invention is a cord take-up device having at least two or more separate fixed spool members having surface features adapted to temporarily receive circumferentially portions of the cord and which spool, members permit movement of the cord portions, upon a pulling motion to adjust the amount of cord to be temporarily stored on the take-up device. The take-up device set forth herein additionally has alignment means to direct the cord onto and over the device.

DESCRIPTION OF PREFERRED EMBODIMENT

The following description is of a preferred embodiment of the subject invention and such description of a preferred embodiment is not to be construed as limiting the scope of the subject invention, as set forth in the annexed claims. Thus, the fact that one embodiment is described in the following description does not preclude the inclusion of other embodiments within the scope of the invention and claims. Moreover, while the subject invention is focused and centered on a window blind cord reel member, the invention can be structured and deployed to other relevant applications in which a dangling or loose cord member can be temporarily or otherwise stored away from a potentially dangerous loose dangling position.

Referring now to the drawings in which a preferred embodiment of the subject invention is shown, cord reel storage member 10 is shown as embodying the concepts of the subject invention, as having a base support member 15, essentially comprising a longitudinally extending frame member 20 integrally holding all the structural elements of the subject invention. Frame member 20 integrally incorporates as fixtures thereto all the structural features of the subject invention, and as such is a unitary member in the preferred embodiment thereof The precise structural aspects of this frame member with its attendant substructure is more fully described below.

It is to be noted that the fact that the invention described herein as set forth as a unitary frame member does not alter the aspect that the subject invention need not be formulated, structured or incorporated in a unitary base frame as such. Moreover, while the subject invention is focused on a mini blind cord reel, the features of the subject invention can be incorporated in a structured member that is not utilized as a window blind cord storage reel. In short, the invention herein can be incorporated in most any type of structure, whether unitary or not, and can be applicable to be used other than a mini blind storage reel in situations wherein there is a need to have a temporary storage reel for a loose cord that may potentially lead to safety or other possible problems.

Figure 2:
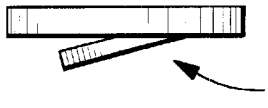
FIG. 2 is an end elevational view of the apparatus shown in FIG. 1.

Referring now more particularly to the drawings and specifically FIGS. 1 and 2, cord storage reel 10 comprises a cord storage base member 15 integrated through a frame 20, as discussed, for receiving different lengths of a mini blind cord 35, with a limited amount of the cord length being pulled and wound around the individual cord take up reel members integrally formed or attached to the frame member 20 of the storage reel member 10. As observed in FIGS. 1 and 2 of the drawings, the frame member 20 comprises the overall, integrated structure of the longitudinally extending storage reel, and is structured as a uniplanar base member as seen from the side elevated view of FIG. 4, which base member is thus formed as a flat member, as seen.

The frame member 20 and thus base member 15 is, in turn, basically formed and defined by a continuously extending perimeter member 40 that is formed preferably, but not necessarily, of a plastic material. The perimeter member 40 forms the extreme outer limits of the base frame structure 20 and is essentially a closed loop member comprising in part of two longitudinally leg members 50A and 50B, joined on their extreme ends to connecting members as more fully discussed below. More specifically, joining the respective ends 60A and 70A, and 60B and 70B of the leg members 50A and 50B are first primary transverse and second primary transverse connecting member 65A and 65B. In particular, the longitudinally extending leg member 50A forms the left longitudinal leg of the perimeter support member, as seen in the front elevational view of FIG. 1, while the longitudinally extending leg 50B forms the right longitudinally extending leg of the base frame member 20, also as seen in the frontal view of FIG. 2. In the preferred embodiment of the subject invention, first primary transverse connecting member 65A is connected on its opposite ends to the first end 60A of the first longitudinally extending leg 50A, and to the first end 60B of the second longitudinally extending leg member 50B, thereby connecting the first longitudinally extending leg and second longitudinally extending leg at the respective upper ends thereof Additionally, second primary transverse member 65B connects the respective lower ends 70A and 70B of the first and second longitudinally extending leg members 50A and 50B respectively, as seen in FIG. 2. By this latter structural arrangement, the perimeter of base frame member 20 is formed as a unitary, continuous loop member when viewed frontally, as seen in FIG. 1, and is generally rectangular, except that the transverse connecting members 65A and 65B are shown as being somewhat rounded, with a convex curvature on the outer surfaces thereof The invention herein does not depend on the base frame support member 20 being of any precise configuration when viewed frontally or otherwise and the transverse connecting members 65A and 65B may be other than the curved as seen in the drawings. Moreover, the longitudinally extending legs 50A and 50B may be other than parallel members or straight as seen, and the perimeter support member may be other than rectangular as viewed frontally, so long as some basic frame support is provided.

As seen in the drawings, particularly FIGS. 1 and 2, the base support member 20 has two additional transverse support members that are interconnected between the first longitudinally extending leg 50A and the second longitudinally extending leg 50B. Specifically, interconnected behind the first longitudinally extending leg 50A and second longitudinally extending leg 50B is first intermediate transverse support member 80A, which is basically and preferably a straight flat member joined transversely between the first leg 50A and second leg 50B just below or near the first transverse connecting member 65A. The second intermediate transverse member 80B is joined between the first longitudinally extending support leg 50A and the second longitudinally extending support leg 50B in a manner similar to the first intermediate transverse support member 80A, as seen in a position spaced an arbitrary distance from the second transverse support member 65B. This spacing of the intermediate support members 80A and 80B is preferably symmetrical and is otherwise arbitrary. More specifically, the intermediate transverse support members 80A and 80B are affixed near the first ends 60A and 60B and second ends 70A and 70B respectively of support legs 50A and 50B and as seen in the drawings in an H-shaped configuration. The intermediate transverse support members 80A and 80B are preferably perpendicular to both the first support leg 50A and the second support leg 50B. More specifically, the intermediate transverse support members 80A and 80B are joined in an H-shaped configuration near the ends of the support legs 50A and 50B, which are shown as being on the upper and lower portions of the back frame member 20, as seen in perspective of the frontal view of FIG. 1.

Figure 3:
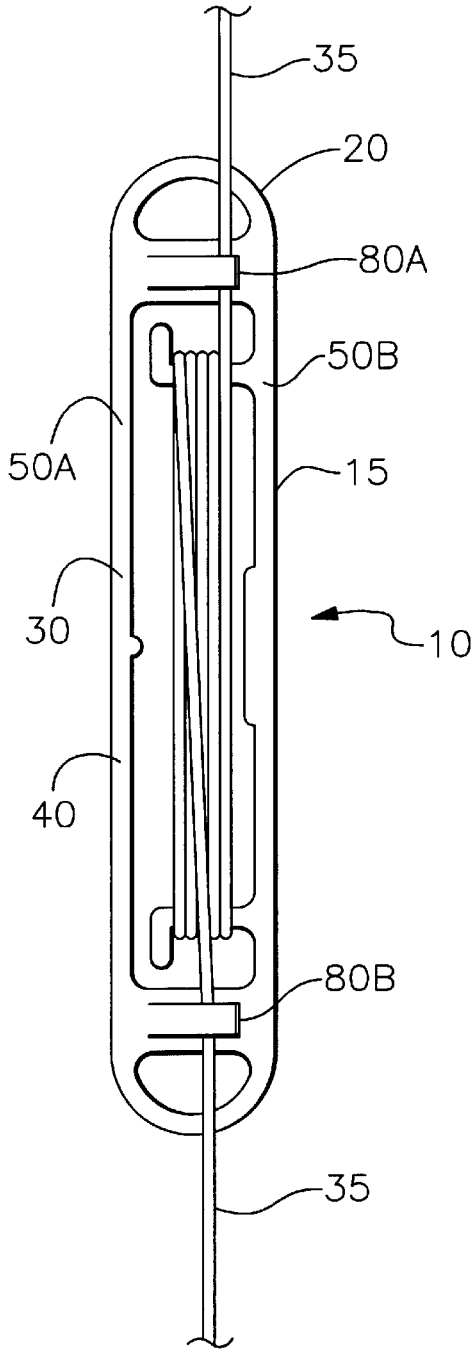
FIG. 3 (2) is a front elevational view of the subject invention demonstrating its use as a cord storage reel.

Formed on the frontal surfaces 100A and 100B, as represented in the drawings, of the first and second intermediate transverse connecting members 80A and 80B are outwardly extending cord restraint members 110A and 110B affixed as tang-like members to a portion of such frontal surfaces. The cord restraint members 110A and 110B are spaced away a minimal distance from the frontal surfaces 100A and 100B so that a cord member, such as cord 35, as used in conjunction with the subject device, may be first placed and threaded between the first cord restraint member 110A and the front surface 100A of intermediate transverse 80A member, as seen in FIG. 3, and eventually through and over the cord reel spool members 140A and 140B integrally formed on the base frame member 20, as more fully discussed below, and thence under the cord restraint member 110B disposed on second intermediate transverse member 80B. These aspects are discussed more fully below.

Additionally, affixed to longitudinally extending leg me 50A at a portion that is between the intermediate transverse connecting members 80A and 80B and projecting into the internal spatial area formed by the perimeter of base support member 20 and affixed to a portion of the inner surface area 135 of the first longitudinally extending leg 50A are two separate fixed longitudinally extending cord reel support 130A and 130B members that form and support fixed cord support spools 140A and 140B. These cord support spools 140A and 140B are fixed and preferably rounded on their respective outer circumferential surfaces 150A and 150B so that cord portions can be readily drawn unhindered around same in a circumferential manner as can be seen in the drawings. These cord supports spools 140A and 140B end short of the second longitudinally extending leg 50B. At the distal end of each of the cord support spool 140A and 140B is a guide post 160A and 160B that is perpendicular to the longitudinally extended leg 50B. At the distal end of each of the cord support spool 140A and 140B and is preferably aligned parallel to the support legs 50A and 50B. In an alternate arrangements the cord supports spools 140A and 140B can be curved in a hook-like manner formed as a semicircular arc as opposed to being straight, as seen in the drawings. In such latter arrangement the cord support spools do not have a separate guide post as such because of the curved nature of the spool members. The cord support spools can be affixed to the support leg 50B, as opposed to support leg 50A.

Figure 4:
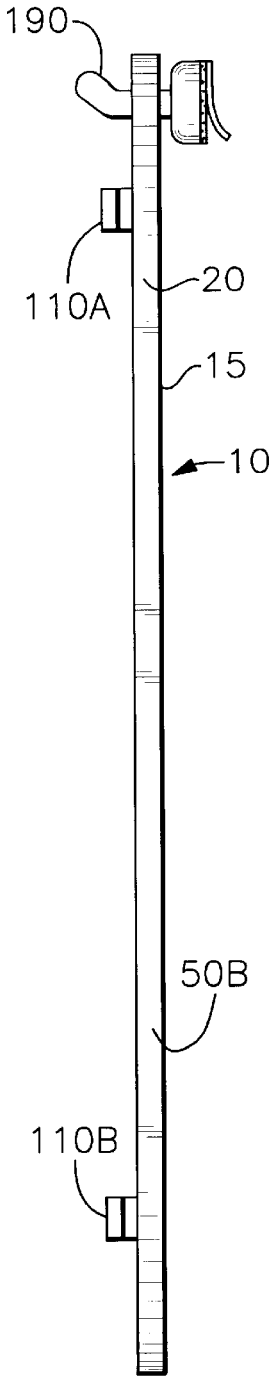
FIG. 4 is a side elevation view of the subject device, shown partially in section.
Figure 5:
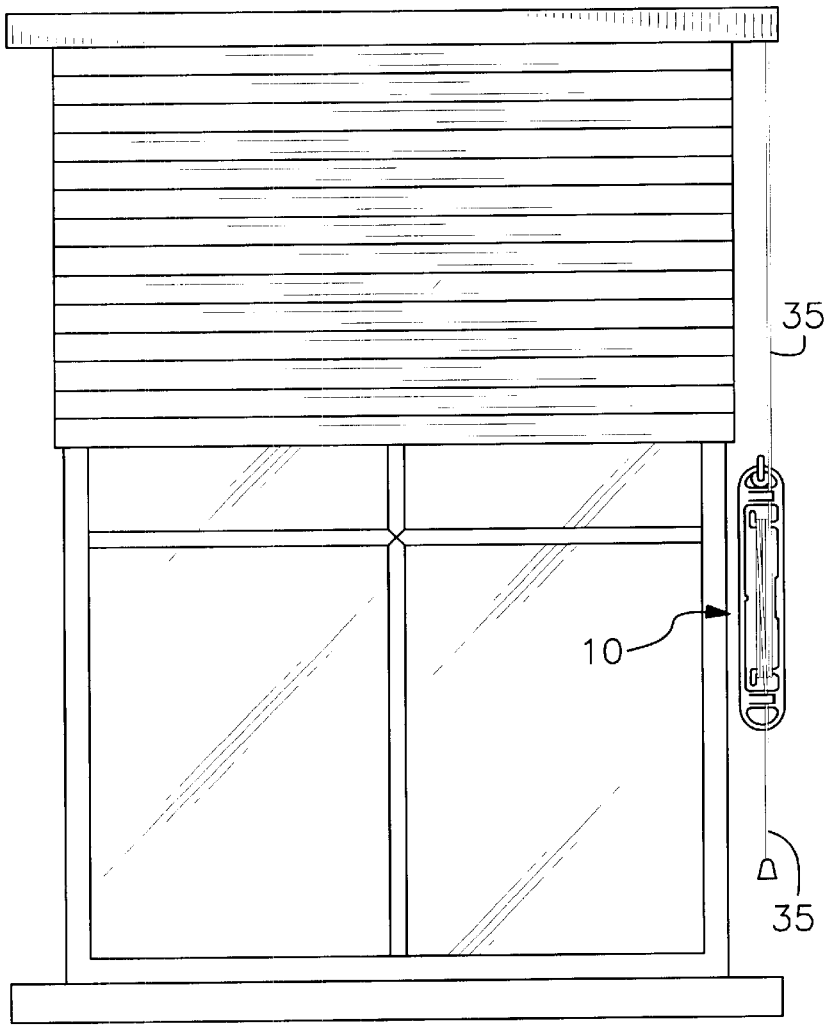
FIG. 5 is an overall frontal view of a window shade demonstrating the utilization of subject apparatus herein.

As an alternate embodiment in the subject invention the frame member is provided in the medial spatial area adjacent to the inner surface 140 of first longitudinally extending leg 50A with a detachable hook member 190 that can be broken off and attached with adhesive backing thereon throughout the upper medial space 170A or lower medial space 170B located between the respective transverse connecting members and the intermediate connecting members respectively, thus allowing the device 10 to be hung on a wall to place it out of the reach as seen in FIGS. 4 and 5.

Alternately described and stated, the subject invention is a cord reel holder 10 especially adapted for venetian blinds or other similar devices which utilize draw cords to operate or consummate the physical cord movements inherent to the device. The cord reel holder 10 incorporating features of the invention herein is structured to take-up and temporarily hold a portion of the cord 35, particularly the lower portion thereof so that the cord is stored out of reach of children.

In the preferred embodiment of the subject invention, the cord reel holder 10 is formed as an elongated base support member 20, having two flanking separated longitudinally extending legs 50A and 50B which are preferably substantially parallel to one another and which legs are joined together by one or more transverse support members 65A and 65B. In the preferred embodiment of the subject invention the longitudinally extending legs 50A and 50B are joined on their first ends by a transverse connecting member and on their second ends by a similar transverse support member. The latter transverse connecting members 65A and 65B are preferably joined to opposing first and second ends of each longitudinally extending leg 50A and 50B respectively. By this latter arrangement. as seen in FIG. 1, the longitudinally extending legs 50A and 50B, along with the end transverse connecting members 65A and 65B, form a continuous loop structure as both a basic and outer base frame 20 structured to hold cord reel spools 140A and 140B. Therefore, as seen in the drawings, this basic frame structure 20 is shown as being basically rectangular with slightly rounded ends. This particularized structure in not critical to the subject invention so long as there is a basic outer frame structure for the subject apparatus.

As seen in the drawings, the longitudinally extending legs 50A and 50B are also joined together by intermediate transverse support member 80A and 80B. These intermediate transverse support members 80A and 80B are positioned perpendicular to the respective joined longitudinally extending support legs 50A and 50B and both are integrally disposed between the end transverse connecting members 65A and 65B, spaced apart at an arbitrary distance, as seen. As represented in the drawings, the intermediate transverse connecting members 80A and 80B each have a flat frontal surface 100A and 100B, which frontal surfaces support a cord restraint tang member 110A and 110B respectively. Specifically, the cord support tang members 110A and 110B are each affixed on their ends, as shown as being on their right ends as seen in FIGS. 1 and 2. These tang members 110A and 110B are affixed and otherwise structured to extend partially outwardly in a frontal direction from the respective frontal surfaces 100A and 100B by just enough distance to permit a strand of the blind cord 35 to pass between the back side of the tang and the front surfaces 100A and 100B of each intermediate transverse support member 80A and 80B. Each intermediate transverse connecting member 80A and 80B with its projecting tang functions to hold a portion of the cord in place as aligned up and down the middle of the cord reel support member 10, as seen in FIG. 3.

Moreover, as seen in the drawings, and particularly FIGS. 2 and 3 projecting laterally inwardly from the first longitudinally extending leg 50A, the leg shown in the left of FIG. 1, is a rounded first cord support spool 140A having an end perpendicular guide post extension 160A disposed on the end therefor. A second spool member 140B, also of rounded configuration, extends also from the inside surface 140 of the first longitudinally extending leg member 50A, and is similar in structure to support spool 140A. The spool members 140A and 140B are spaced apart between the intermediate connecting members 80A and 80B and each cord spool 140A and 140B is adapted to have a portion of the cord wrapped around the outer circumferential surface thereof for temporary storage purposes and movement thereout. Thus, the subject apparatus has cord 35 deployed thereon as seen in FIG. 3, with cord being wound about the two cord support spool members 140A and 140B and held so that the cord can be moved as necessary around the spools in order to lengthen or shorten the exposed cord length, as seen.

What is claimed is:

1. A cord reel storage device for winding and storing a portion of a cord member on said device comprising:

(a) a base frame structure, said base frame structure having a first longitudinally extending leg member and a second longitudinally extending leg member said first and second longitudinally extending leg members being substantially aligned parallel to one another;

(b) a first curved transverse connecting member interconnecting portions of said first longitudinal extending leg to a portion of said second longitudinally extending leg of said frame structure, with said first transverse connecting member forming a continuous perimeter on the outer edges of said base frame structure forming a closed loop frame member;

(c) a second curved transverse connecting member interconnecting portions of said first longitudinally extending leg to a portion of said second longitudinally extending leg of said frame structure, with said first transverse connecting member forming a continuous perimeter on the outer edges of said base frame structure forming a closed loop frame member;

(d) a first cord reel storage member integrally disposed on said base frame structure, and wherein said first cord storage reel member is structured to receive in a circumferential fashion around said first cord reel storage member multiple strands of cord for temporary storage of said multiple strands of cord and movement about said first cord reel storage member;

(e) a second cord reel storage member integrally disposed on said base frame structure, wherein said second cord storage reel member, is structured to receive in a circumferential fashion around said second cord storage reel member multiple strands of cord for temporary storage on said second cord reel storage member;

(f) guide means disposed on said base structure to guide the cord wound on said base structure, said guide means comprising a longitudinally extending tang member that extends longitudinally on the surface of said first transverse connecting member to hold said cord between said tang and the outer surface of said first cord reel storage member:

(g) hook means connected to said base frame structure to be broken off from said base frame structure and placed on a wall to hold the said base frame in a position on a wall.

2. A cord reel storage device for winding and storing a portion of a cord member on said device comprising:

(a) a base structure, said base structure having a perimeter frame member, said perimeter frame member having a first longitudinally extending member and a second longitudinally extending member that are substantially parallel to one another;

(b) a first transverse connecting member interconnecting a portion of said first longitudinally extending member of said base structure to a portion of said second longitudinally extending member;

(c) a second transverse connecting member interconnecting a portion of said first longitudinally extending member to a portion of said second longitudinally extending member said second transverse connecting member being spaced away from the first transverse connecting member;

(d) cord spool storage members integrally disposed between said first transverse connecting member and said second transverse connecting member on said base structure and adapted to circumferentially receive portions of a cord member for temporary storage of such cord member;

(e) guide means disposed on said base structure to guide the cord member wound on said base structure, said guide means comprising a longitudinally extending tang member that extends longitudinally on the surface of said first transverse connecting member to hold said cord between said tang and the outer surface of said first transverse connecting member:

(f) hook means connected to said base structure to be broken off from said base structure and placed on a wall to hold said base structure in a position on a wall.

3. A cord reel storage device for winding and storing a portion of a cord member on said device comprising:

(a) a base structure, said base structure having a perimeter frame member, said perimeter frame member having a first longitudinally extending leg member and a second longitudinally extending leg member that are substantially parallel to one another;

(b) a first primary transverse connecting member interconnecting a portion of said first longitudinally extending leg to a portion of said second longitudinally extending leg on said base structure;

(c) a second primary transverse connecting member interconnecting with a portion of said first longitudinally extending leg member to a portion of said second longitudinally extending leg, said second transverse connecting member being spaced away from said first transverse connecting member;

(d) a first secondary transverse connecting member interconnecting a portion of said first longitudinally extending leg to a portion of said second longitudinally extending leg;

(e) a second secondary transverse connecting member interconnecting a portion of said first longitudinally extending leg to a portion of said second longitudinally extending leg;

(f) a first cord storage spool integrally affixed on said base structure, said first cord storage spool structured to circumferentially receive a portion of the cord member, for both storage and movement of the cord member around said first cord storage spool;

(g) a second cord storage spool integrally affixed on said base structure, said second cord storage spool structured to circumferentially receive a portion of the cord member, for both storage and movement of the cord member around said second storage spool;

(h) guide means disposed on said base structure to guide the cord wound on said base structure, said guide means comprising a longitudinally extending tang member that extends longitudinal on the surface of said first transverse connecting member to hold said cord member between said tang and the outer surface of said first transverse connecting member.

4. A cord reel winder device for winding a portion of a cord member around said winder device comprising:

(a) a base structure, said base structure having,a perimeter frame member, said perimeter frame member having a first longitudinally extending leg member and a second longitudinally extending leg member that are substantially parallel to one another;

(b) transverse connecting members interconnecting a portion of said first longitudinally extending leg to a portion of said second longitudinally extending leg on said perimeter frame member;

(c) multiple cord reel storage spools on said base structure, each said cord storage spool being affixed transversely to one of said longitudinally extending legs and wherein each of said respective cord reel spools has a rounded outer surface for receiving a portion of said cord member for temporary storage purposes;

(d) guide means disposed on said base structure to guide the cord wound on said base structure, said guide means comprising a longitudinally extending tang member that extends longitudinally on the surface of said first transverse connecting member to hold said cord between said tang and the outer surface of said base structure;

(e) hook means connected to said base structure to be broken off from said base structure and placed on a wall to hold the said base structure in a position on a wall.

* * * * *